US005538327A

United States Patent [19]

Martorella et al.

[11] Patent Number: 5,538,327

[45] Date of Patent: Jul. 23, 1996

[54] METHOD AND APPARATUS FOR MAKING A MOP HEAD AND A MOP HEAD MADE THEREWITH

[76] Inventors: Rudolph Martorella, 525 E. 86th St. Apt. 15D, New York, N.Y. 10028; Robert Chalfant, 1542 Atchinson St., Atchinson, Kans. 66002; Terrance Chalfant, Lewis & Clark Village, Mo. 64484; Philip Mayer, 17200 Red Hill Ave., Irvine, Calif. 92714

[21] Appl. No.: 121,689

[22] Filed: Sep. 15, 1993

(Under 37 CFR 1.47)

[51] Int. Cl.[6] ..... A47L 13/20

[52] U.S. Cl. ..... 300/21; 300/16

[58] Field of Search ..... 300/16, 21

[56] References Cited

U.S. PATENT DOCUMENTS

| | | | |
|---|---|---|---|
| 1,209,639 | 12/1916 | Carter | 300/21 |
| 1,882,605 | 10/1932 | Horsley | 300/16 |
| 3,027,198 | 3/1962 | Barr | 300/16 |
| 3,068,505 | 12/1962 | Lindstrom | 300/21 X |
| 3,100,670 | 8/1963 | Bennett et al. | 300/16 |
| 3,279,859 | 10/1966 | Blazek et al. | 300/16 |
| 4,790,603 | 12/1988 | Harmon et al. | 300/16 |

*Primary Examiner*—John Husar

*Attorney, Agent, or Firm*—Galgano & Burke

[57] ABSTRACT

A machine for making mop heads includes a pair of parallel forward moving conveyor chains and a yarn winder upstream of the conveyor chains. A continuous supply of yarn is wound by the winder around the outside of the conveyor chains as the chains are moving forward. Downstream of the winder, two rolls of fabric apply a narrow strip of fabric to the yarn at opposite ends inside the conveyor chains. A pair of sewing machines stitch the fabric to the yarn to form opposite end loops around the conveyor chains. Periodically, the winder is stopped or slowed while the conveyor chains continue to move forward forming a long angled loop in the yarn dividing groups of yarn loops. A centrally located taping device sequentially encircles each group of yarn loops at a point equidistant between the conveyor chains. Downstream of the conveyor chains, a pair of rotating arms collect individual taped and stitched groups of yarn loops and a cutter cuts the fabric strips and yarn between each bunched group. One of the rotating arms is provided with a supply of ring wire which is automatically threaded into the end loops. The resulting groups of yarn have a generally "figure 8" configuration with end loops strung together on a curved wire. The ends of the curved wire are manually attached to form a ring. A mop head made with the machine has a single yarn which is looped, stitched and taped and carded on a ring for use with a self-wringing mop.

14 Claims, 11 Drawing Sheets

METHOD AND APPARATUS FOR MAKING A MOP HEAD AND A MOP HEAD MADE THEREWITH

This application is related to U.S Pat. No. 4,130,910, the complete disclosure of which is incorporated herein by reference.

BACKGROUND OF THE INVENTION

1. Field of the Invention

The invention relates to mops having fibrous heads formed from strings of yarn, e.g. cotton yarn. More particularly, the invention relates to a machine for making fibrous yarn mop heads, a method for using the machine to make mop heads, and mop heads made with the machine.

2. State of the Art

The state of the art is well represented by U.S. Pat. No. 4,130,910 which discloses a wringer type mop (such as that shown in prior art FIGS. 1*a*–1*c*) having a fibrous yarn head 10 with a ring 12 engaging the yarn strands and is forming them into loops. The ring 12 is carried on a sleeve 14 which is slideable and rotational over the mop handle 16. The handle has a cup 18 projecting from one end and engaging the loop strands at a knot 11 intermediate their ends 13 by a pin 22 which is inserted into holes 20 (FIG. 1*c*). When the sleeve 12 is in one position the strands have their intermediate portions withdrawn toward the sleeve and in cross-section define a generally cardioid shape, while in another position the strands are stretched out to define a general cylindrical shape. In the second position, the strands can be wrung by a relative twisting action between the sleeve 14 and the handle 16. The yarn is twisted to wring moisture therefrom, and experience has indicated that twisting is a very effective way of removing moisture from the yarn. In addition, the yarn does not have loose ends which whiplash across a floor when the mop is being used, so that there is a more effective mopping action on the floor. The drying effect of the yarn is more efficient than with prior art mops squeezed by other methods, or with sponge type mops. Since the strands can be stretched out to occupy a generally cylindrical shape and are not compressed in a socket, drying is facilitated and the objectionable odour and rotting of fibres sometimes associated with damp mops which do not properly dry is substantially reduced.

One of the difficulties with this type of mop is the securing of the yarn loops to the sleeve 14 and the cup 18. This is accomplished by constructing a mop head having a ring 12. The ring 12 passes through the looped ends 13 of the yarn strands and the intermediate portions 11 of the yarn strands between looped ends is tied or bunched. This facilitates attachment of the yarn to the sleeve 14 and the cup 18 and also facilitates replacement of the mop head when necessary. As shown in prior art FIGS. 1*a*–1*c*, the ring 12 of the mop head is placed over the handle 16 and moved onto the sleeve 14 toward the cup 18. The bunched intermediate portion 11 of the mop head is inserted into the cup 18 and is secured there by pin 22 in holes 20.

The main disadvantage of the mop described above is the difficulty in assembling the mop head so that the yarn strands loop over the ring and are bunched or tied in their intermediate portion. So far, this assembly has been done by hand and because of that, the resulting mop heads are relatively expensive.

SUMMARY OF THE INVENTION

It is therefore a general object of the invention to provide an automated means for constructing a mop head consisting of a plurality of looped yarn strands connected to a ring and having their intermediate portions tied or bunched together.

It is also an object of the invention to provide an automated means for constructing a mop head which uses a continuous strand of yarn to form a plurality of yarn loops which are bunched at their middle.

It is another object of the invention to provide an automated means for bunching a middle portion of a plurality yarn loops by taping.

It is still another object of the invention to provide an automated means for stitching opposite ends of a plurality of yarn loops to provide end loops through which a ring can be inserted.

It is also an object of the invention to provide automatic means for measuring the yarn used to form loops so that each mop head produced is substantially identical.

In accord with these objects which will be discussed in detail below, the mop head making machine of the present invention includes a pair of parallel forward moving conveyor chains and a yarn winder at the rear of the conveyor chains. A continuous supply of yarn strand is wound by the winder around the outside of the conveyor chains as the chains are moving forward. This creates a forward moving continuous helix of yarn. Forward of the winder and above the conveyor chains, two rolls of fabric apply a narrow strip of fabric to the yarn at opposite ends inside the conveyor chains. Forward of the fabric rolls, a pair of sewing machines stitch the fabric to the yarn helix to form opposite end loops around the conveyor chains. Periodically, the winder is stopped or slowed while the conveyor chains continue to move forward thereby forming a long angled loop in the continuous helix of yarn to divide a series of substantially equal groups of helical yarn loops. A centrally located taping device sequentially encircles each group of helical yarn loops at a point equidistant between the conveyor chains. Forward of the front end of the conveyor chains, a pair of rotating arms collect individual taped and stitched groups of helical yarn loops and a cutter cuts the fabric strips and yarn between each bunched group. One of the rotating arms is provided with a supply of ring wire which is automatically threaded into the end loops. The resulting groups of yarn have a generally "figure 8" configuration with end loops strung together on a curved wire. The ends of the curved wire are then manually attached to form a ring.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1A:
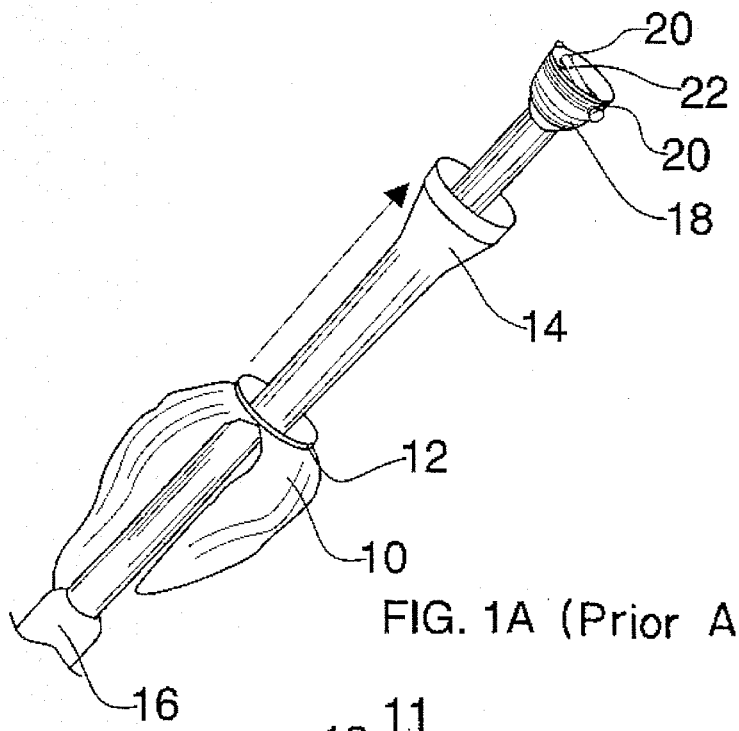
FIG. 1A (Prior Art)
FIG. 1*a* is a perspective view of a prior art mop with a mop head in the first stage of attachment.
Figure 1B:
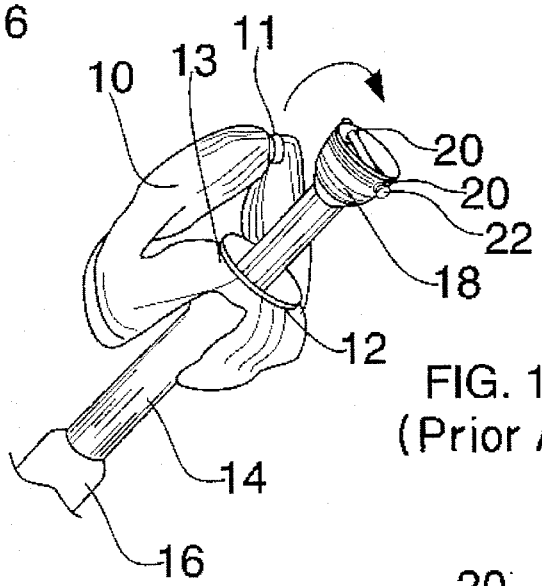
FIG. 1B (Prior Art)
FIG. 1*b* is a perspective view of a prior art mop with the mop head in the second stage of attachment.
Figure 1C:
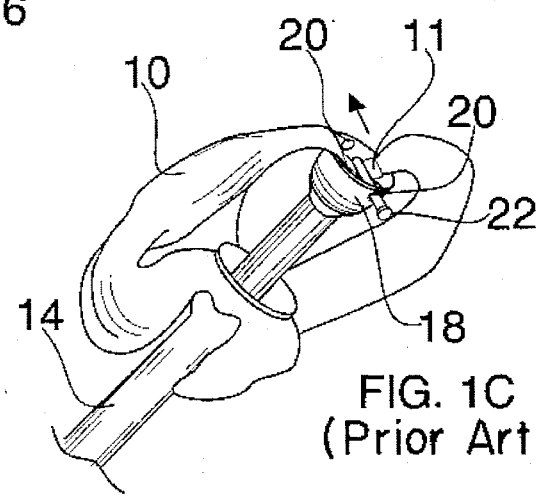
FIG. 1C (Prior Art)
FIG. 1*c* is a perspective view of the end of the prior art mop with the mop head in the third stage of attachment.
Figure 2:
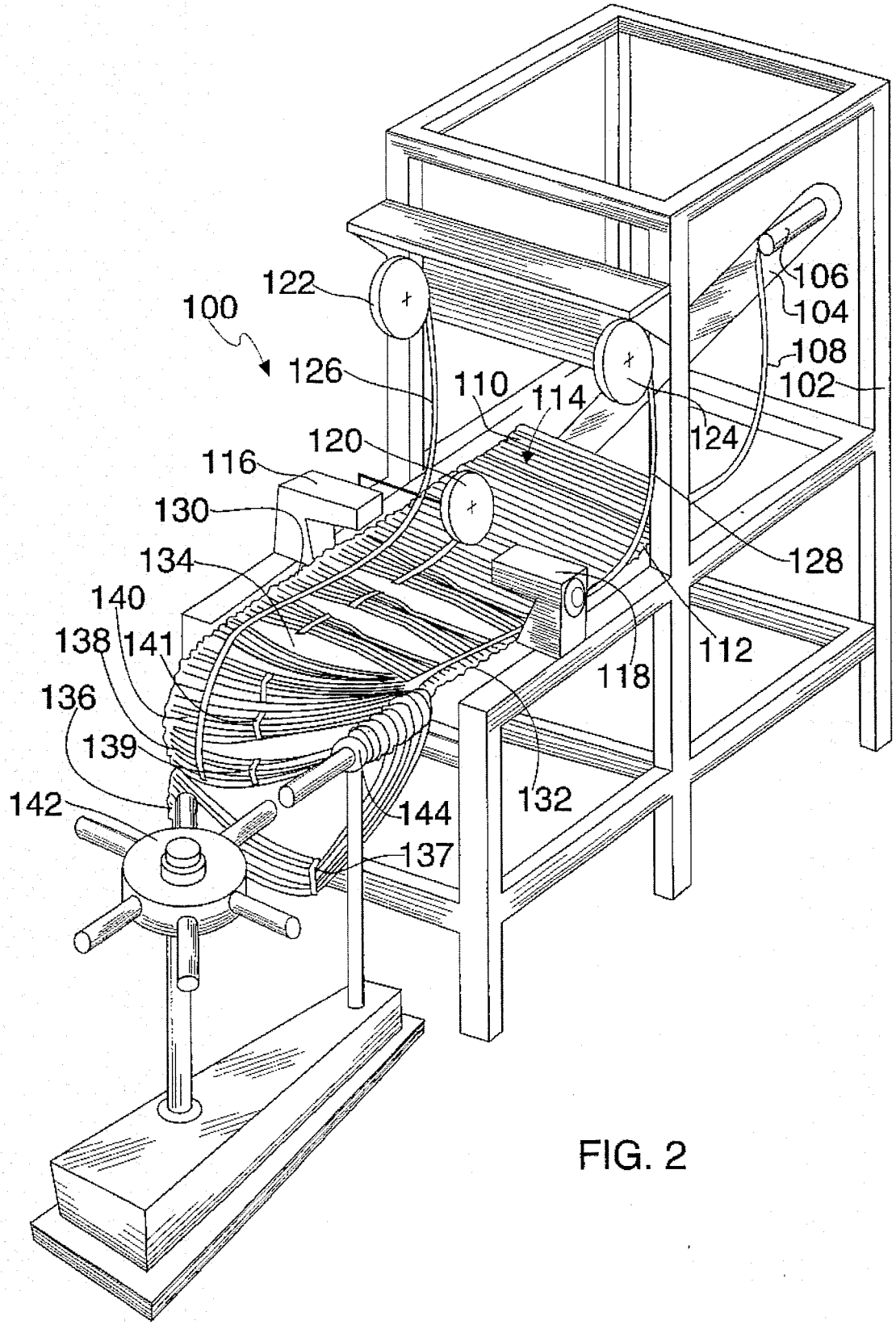
FIG. 2 is a perspective view of a first embodiment of the invention.

Turning now to FIG. 2, a first embodiment 100 of the apparatus for making mop heads is shown in perspective view from the front. The apparatus 100 generally includes a frame 102 which carries a rotating winder 104 having a yarn carrying arm 106 over which a continuous supply of four ply cotton yarn 108 is wrapped around a pair of forward moving chain conveyors 110, 112. As the yarn 108 is wound in a vertical plane about the forward moving conveyors 110, 112, a forward moving continuous helix 114 of yarn 108 is advanced in a horizontal plane toward a pair of sewing machines 116, 118 and a taping machine 120. A pair of fabric rolls 122, 124 are mounted on an upper part of frame 102 and feed relatively narrow fabric strips 126, 128 on top of the helix 114 adjacent the conveyors 110, 112. Sewing machines 116, 118 stitch the fabric strips to the helix 114 of yarn 108 to form closed loops 130, 132 around the conveyors 110, 112. Periodically, the winder 104 is stopped or slowed so that the space (e.g. 134) between individual coils of the helix 114 is widened. The widened space allows taping machine 120 to encircle groups (e.g. 136, 138, 140) of helical coils of yarn and apply a bunching tape (e.g. 137, 139, 141) to the center of these groups. As the groups of stitched and taped helical coils of yarn approach the end of conveyors 110, 112, cutters (not shown) cut the fabric strips 126, 128 and yarn 108 separating the individual groups 136, 138, 140, etc. from each other. Conveyors 110, 112 feed one looped ends 130, 132 onto a rotating arms 142, 144. Arm 142 is provided with an internal supply of coiled wire and collects the yarn by end loops 130. Arm 144 includes a piston device (not shown) and collects the yarn by end loops 132. Arm 144 rotates counterclockwise and arm 142 rotates clockwise toward arm 144. The piston device in arm 144 slides the loops 132 onto the arm 142 alongside the loops 130. Arm 142 then rotates into third position where the loops and the internal curved wire can be removed from arm 142. The curved wire is then attached by its ends to form a ring on which the looped ends of the yarn reside. The resulting mop head operates in the same way as the manually assembled mop head shown best in prior art FIG. 1*b*.

Figure 3:
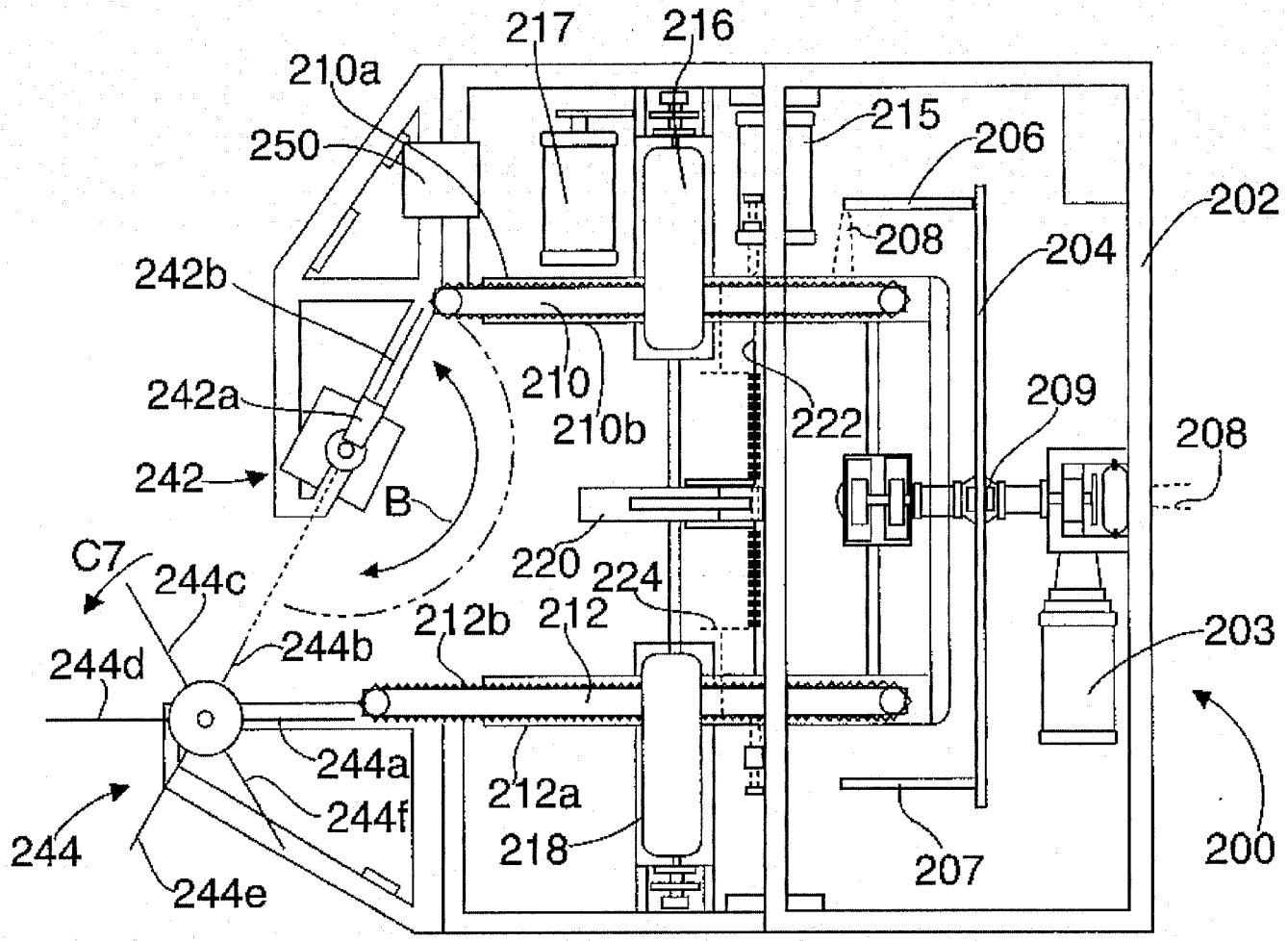
FIG. 3 is a top plan view of a second preferred embodiment of the invention.
Figure 4:
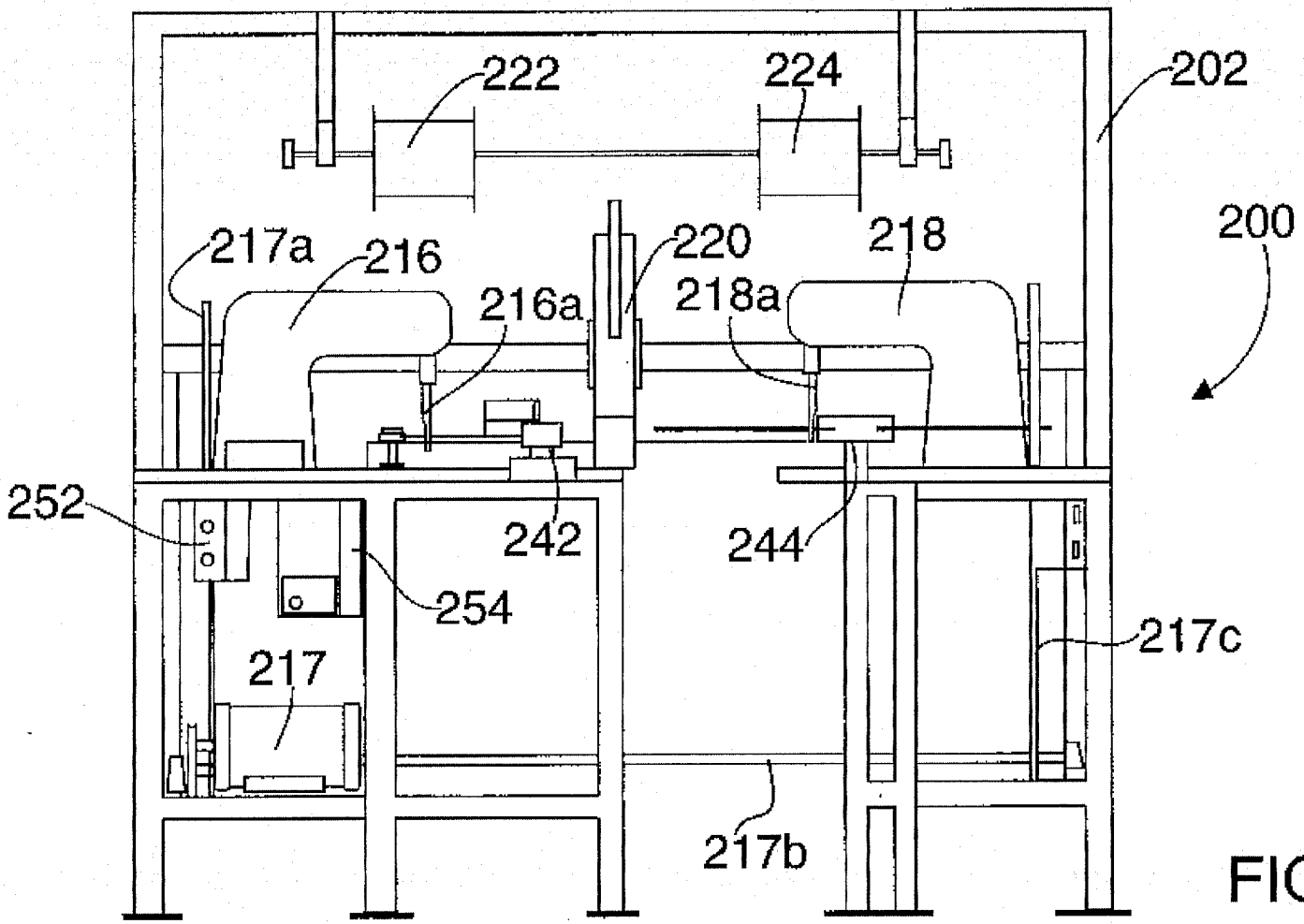
FIG. 4 is a side elevation view of front end of the embodiment of FIG. 3.
Figure 5:
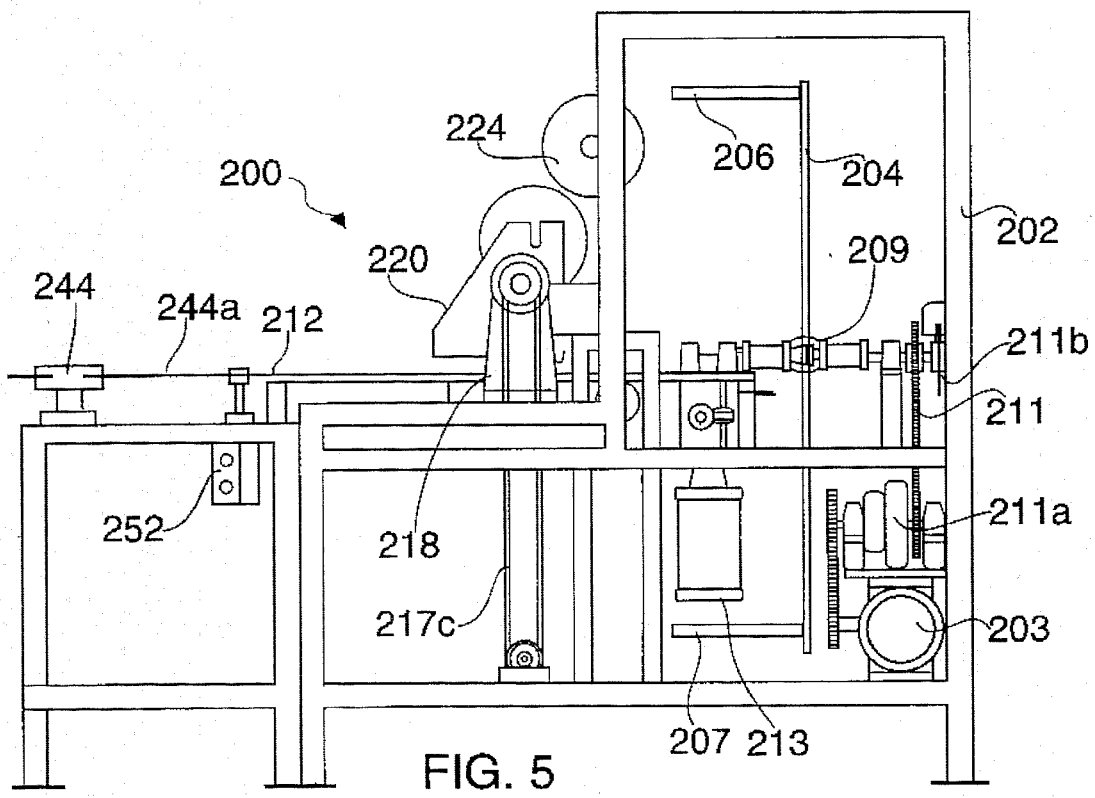
FIG. 5 is a side elevation view of the right side of the embodiment of FIG. 3.
Figure 6:
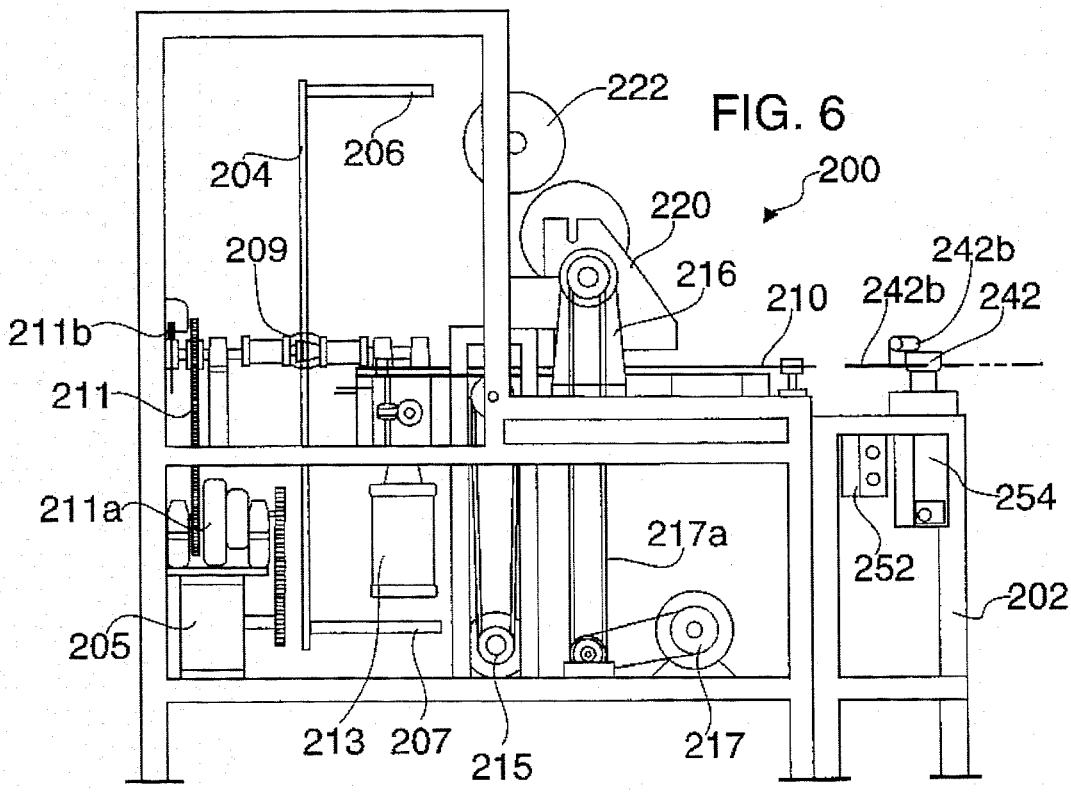
FIG. 6 is a side elevation view of the left side of the embodiment of FIG. 3.
Figure 7:
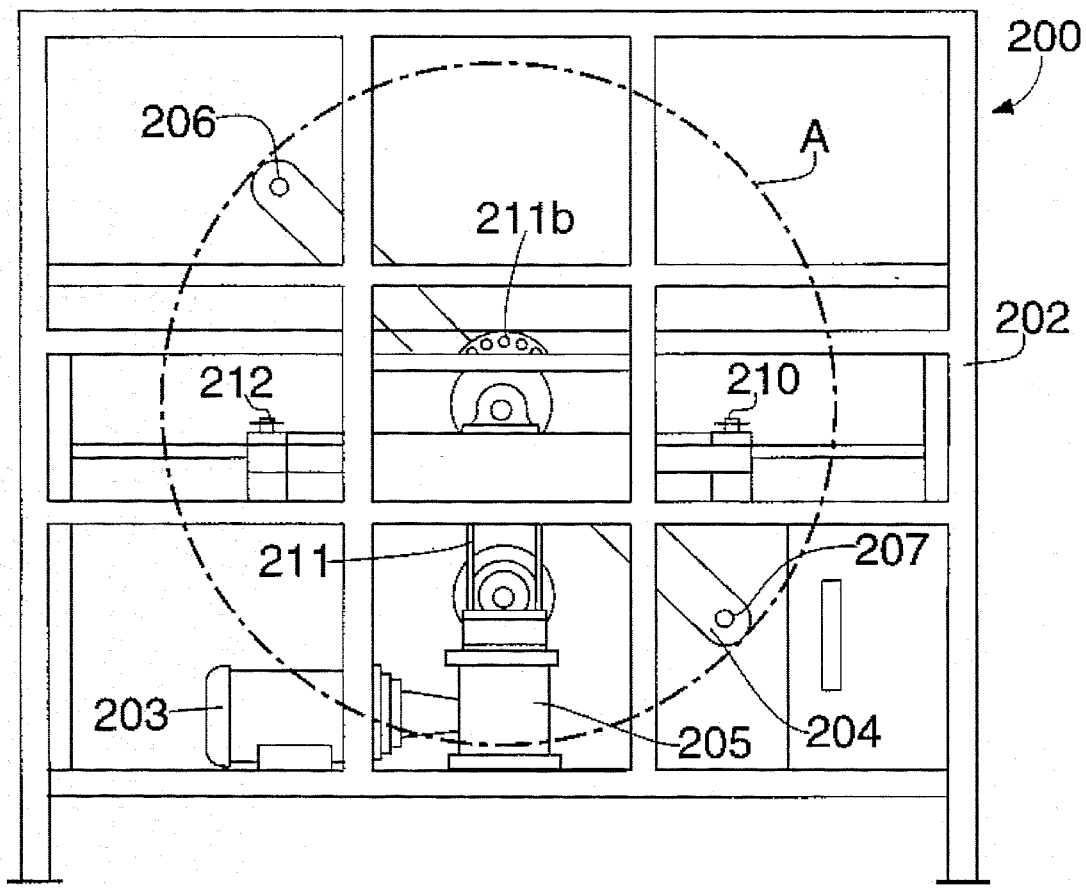
FIG. 7 is a side elevation view of the rear end of the embodiment of FIG. 3.
Figure 8A:
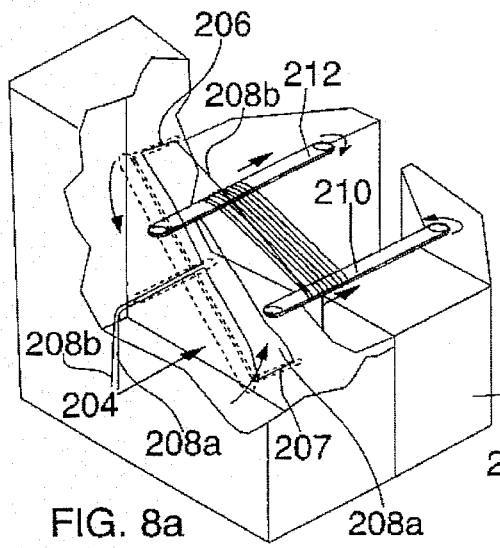
FIGS. 8*a*–8*i* show details of the invention in connection with method steps for making the inventive mop head.
Figure 8B:
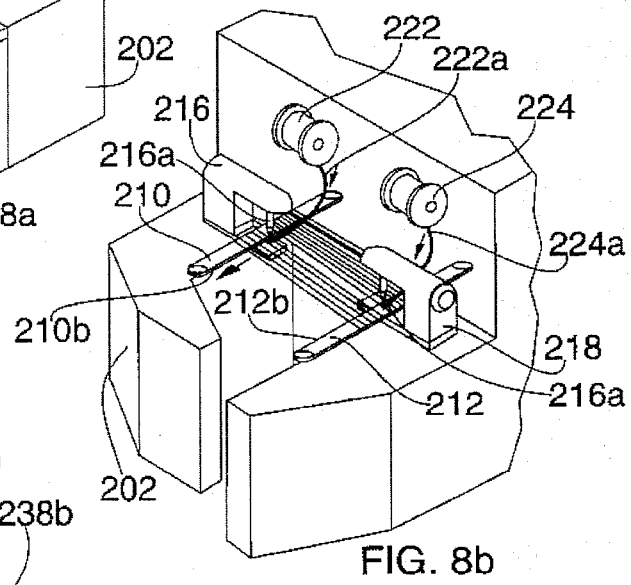

Turning now to FIGS. 3–7 and 8*a*–8*i*, a preferred embodiment 200 of the invention is shown and described in greater detail. The apparatus 200 includes a a frame 202 which carries a high speed yarn winder 204 having a pair of arms 206, 207 which wrap a continuous supply of cotton yarn 208 around a pair of chain conveyors 210, 212. As seen best in FIGS. 3 and 8*a*, yarn 208 is fed to winder 204 from the rear in two strands 208*a*, 208*b*. The winder is powered by a pneumatic motor 203 coupled to the winder by a gearbox 205 and a chain drive 211 having an air operated clutch 211*a* and an air operated disc brake 211*b*. The yarn is kept continuous by a rotary type electrical splicer 209 (seen best in FIGS. 5 and 6). The winder rotates 360 degrees around the conveyors as shown in FIG. 7 by the phantom line A and as shown by the arrows in FIG. 8*a*. Conveyor chains 210, 212, driven by motor 213 move the yarn forward in a horizontal plane as described above. It will be appreciated from the top view shown in FIG. 3 and the perspective view of FIG. 8*a*, that the chain 210 moves in a counter-clockwise direction while the chain 212 moves in a clockwise direction. The outer portion 210*a* of chain 210 and the outer portion 212*a* of chain 212, therefore, both move forward (downstream) away from the winder 204.

Sewing machines 216, 218 are mounted on the frame 202 adjacent the conveyors 210, 212 with their sewing needles 216*a*, 218*a* inside the inner portions 210*b*, 212*b* of the chain conveyors. Sewing machines 216, 218 are chain driven by chains 217*a*, 217*c* from a single pneumatic motor 217 and a transmission rod 217*b*.

Fabric rolls 222, 224 are mounted on the frame above and slightly upstream of the sewing machines and provide the sewing machines with a continuous supply of narrow fabric 222*a*, 224*a* which is sewn to the yarn as described above and shown in FIG. 8*b*. The fabric rolls are chain driven by an electric motor 215.

Figure 9:
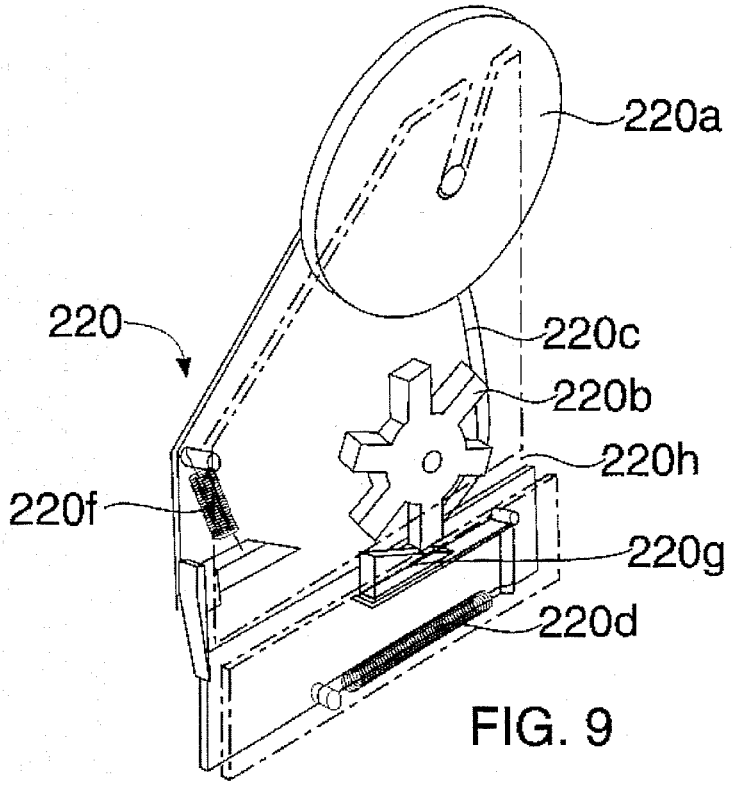
FIG. 9 is a transparent perspective detail of the taping machine.
Figure 9A:
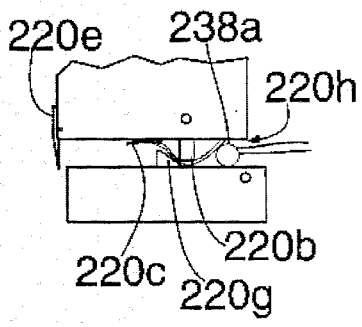
FIGS. 9*a*–9*h* show details of the operation of the taping machine in sequence.
Figure 9B:
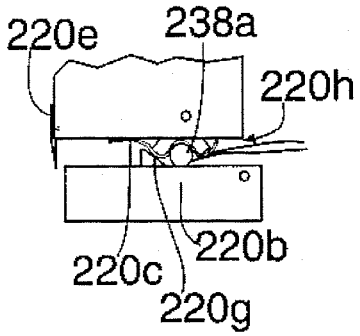
Figure 9C:
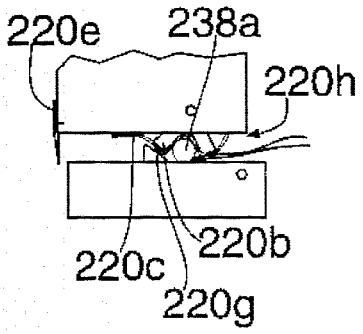
Figure 9D:
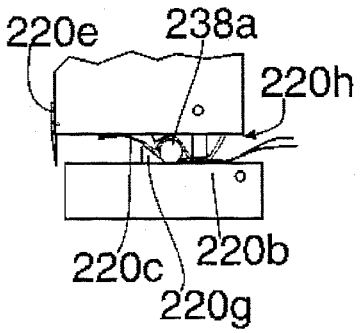
Figure 9E:
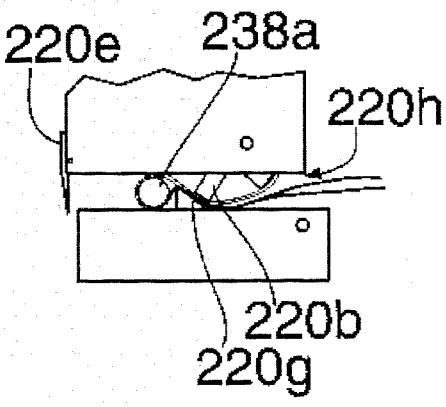
Figure 9F:
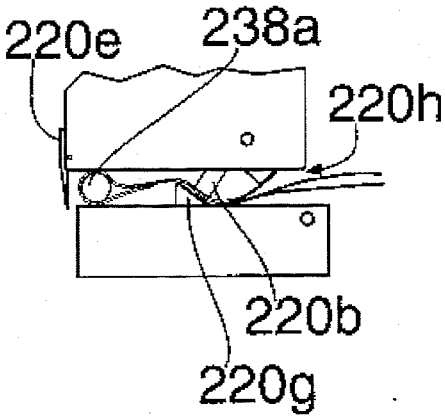
Figure 9G:
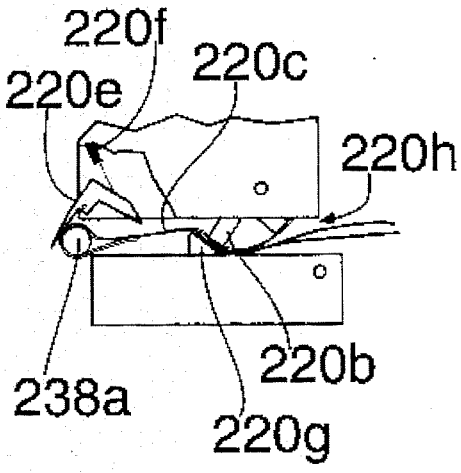
Figure 9H:
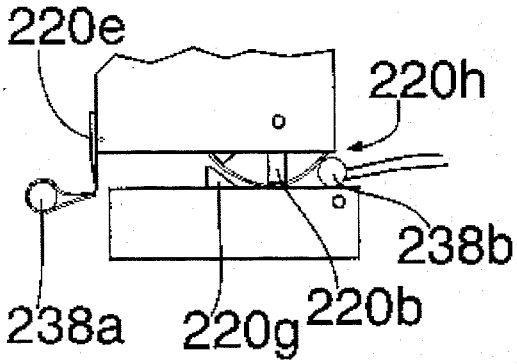

Taping machine 220 is centrally located and extends slightly downstream of the sewing machines. The taping machine is provided with an inner mechanism which wraps tape around a group of yarn as described above and as shown in more detail in FIG. 9. As seen in FIG. 9, the taping machine 220 includes an upper tape roll 220 feeding tape 220*c* to a spoked feeding wheel 220*b* which transects the path 220*h* taken by the yarn as described above. A yarn pressure pad 220*g* is biased against the spoked wheel by a tension spring 220*d*. Downstream of the spoked feeding wheel, an L-shaped cutting member is held in an upright position by a return spring 220*f*. As seen in FIGS. 9*a*–9*h*, as a yarn bunch 238*a* enters the path 220*h*, it engages tape 220*c* and is grabbed between spokes of the wheel 220*b*. Yarn pressure pad 220*g* keeps the yarn bunch 238*a* inside the spokes and causes it to rotate slightly as tape 220*c* is wrapped around it. The taped yarn bunch 238*a* exit the feeder wheel 220*b* (FIG. 9*e*) and continues to move downstream until it hits the downward leg of the cutter 220*e*. It engages the leg of the cutter moving it against the spring 220*f* as seen in FIG. 9*g*, causing the cutter to cut the tape 220*c* upstream of the yarn bunch 238*a*. Meanwhile a next yarn bunch 238*b* enters the taping machine as seen in FIG. 9*h*.

Figure 8C:
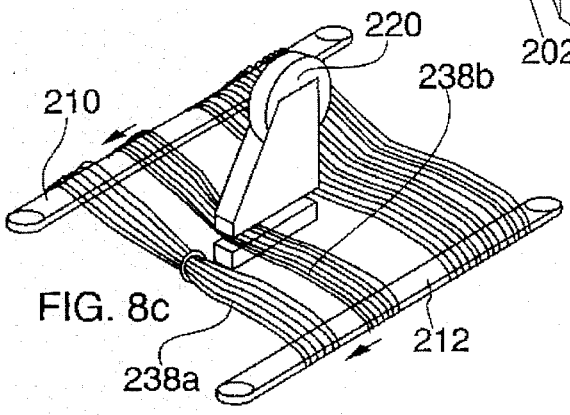
Figure 8D:
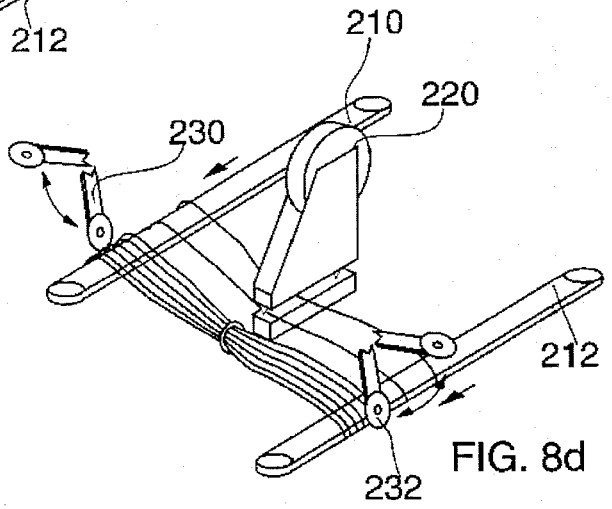

A pair of cutting devices 230, 232, shown schematically in FIG. 8*d*, are swingably mounted downstream of the taping machine 220 adjacent respective conveyors 210, 212.

A reciprocating arm 242 is mounted at the downstream end of conveyor 210. Arm 242 rotates approximately 180 degrees a shown by the arrows B and the phantom lines in FIGS. 3 and FIGS. 8*e* through 8*h*. Arm 242 is provided with a pneumatic cylinder 242*a* and an extendable indexing rod 242*b*.

A rotating wheel 244 with six arms 244*a*–244*f* is mounted at the downstream end of conveyor 212. Wheel 244 rotates stepwise in the direction shown by arrow C in FIG. 3 and FIGS. 8*f* and 8*g*.

From the foregoing description, the operation of the machine can be appreciated in the sequence of steps performed with reference to FIGS. 8*a*–8*i*. As the yarn strands 208*a*, 208*b* are wound around conveyors 210, 212, they are conveyed towards sewing machines 216, 218 as seen in FIG.

8*b*. Fabric strips 222*a*, 224*a*, supplied by rolls 222, 224, are sewn to the yarn loops as described above and as seen best in FIG. 8*b*.

The yarn loops are bunched and taped by taping machine 220 as seen best in FIG. 8*c*, forming yarn bunches 238*a*, 238*b*, etc.

The yarn bunches 238*a*, 238*b*, etc. are separated from each other by cutting devices 230, 230 which reciprocally engage edges of conveyors 210, 212 as seen best in FIG. 8*d*.

As the yarn bunches exit the conveyors 210, 212, (as shown in FIGS. 8*e*–8*h*) rod 242*b* and arm 244*a* receive the yarn as described above. Arms 244*a*–244*f* are provided with individual wires (344*a*–344*f*) which are manually fed through coaxial openings in the arms.

Figure 8E:
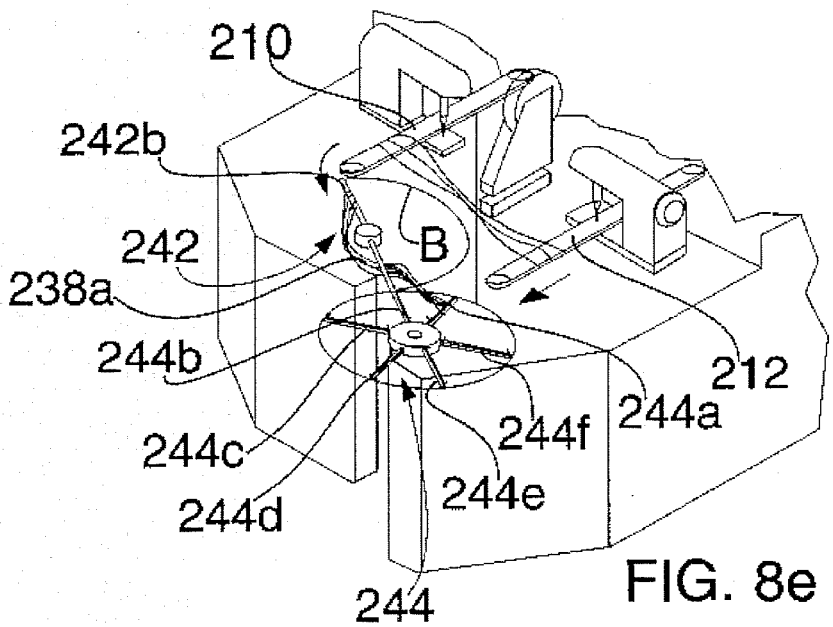
Figure 8F:
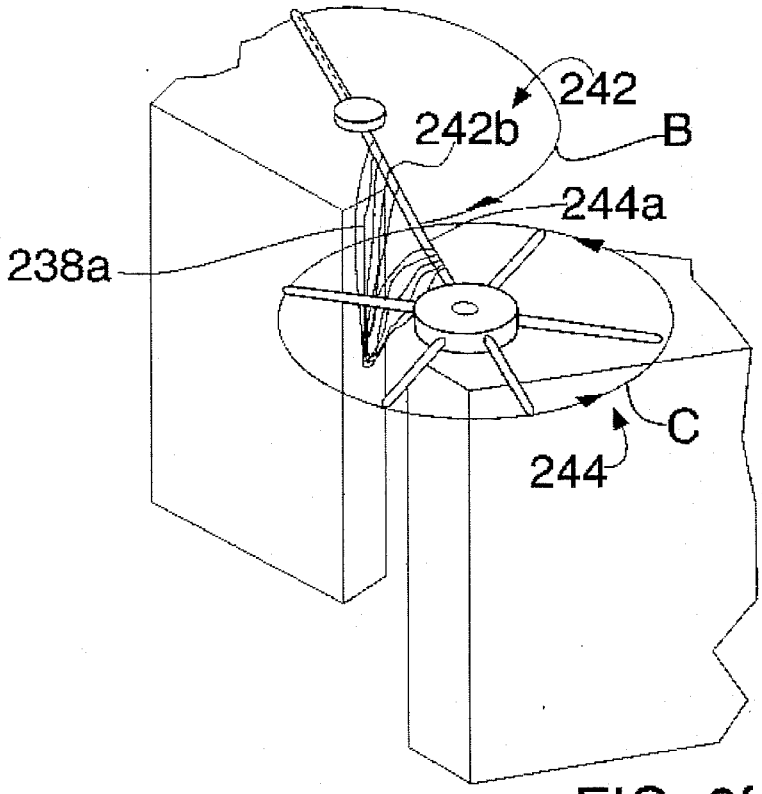
Figure 8G:
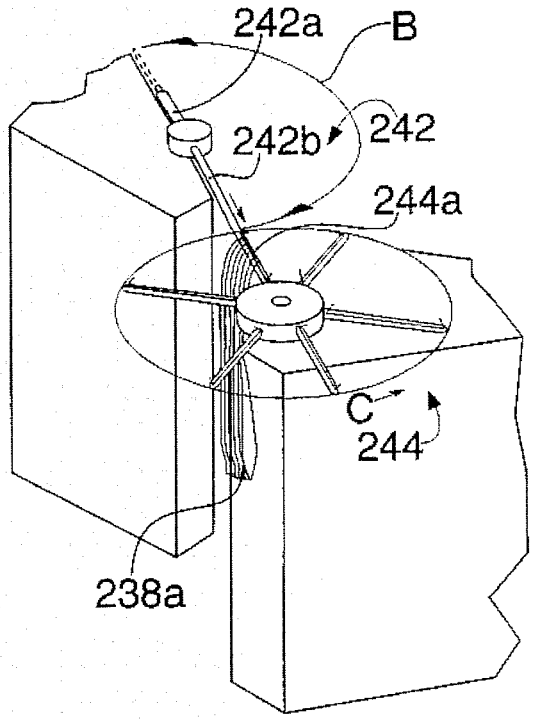

When a bunched (taped) group of yarn loops 238*a* is deposited on rod 242*b* and arm 244*a* as shown in FIG. 8*e*, wheel 244 rotates one step counter-clockwise so that the yarn loops from conveyor 212 are brought shown in FIG. 8*f* previously occupied by arm 244*b*. Rod 242*b* is rotated clockwise so that the yarn loops from conveyor 210 are brought into the position shown in FIG. 8*f*. Cylinder 242*a* pushes the yarn loops which were taken from conveyor 210 onto the arm 244*a* alongside the loops which were taken from a conveyor 212 as shown in FIG. 8*g*.

The curled wire in the coaxial opening in the arm 244*a* now resides in the loops of the yarn which now all reside on the arm 244*a*.

Figure 8I:
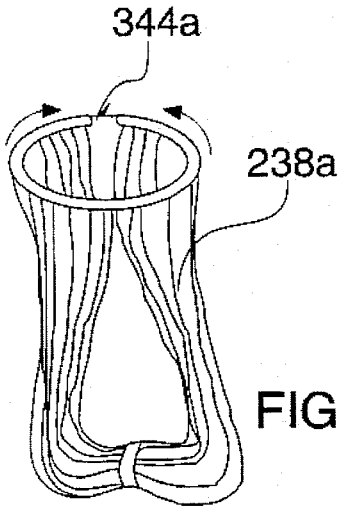
Figure 8H:
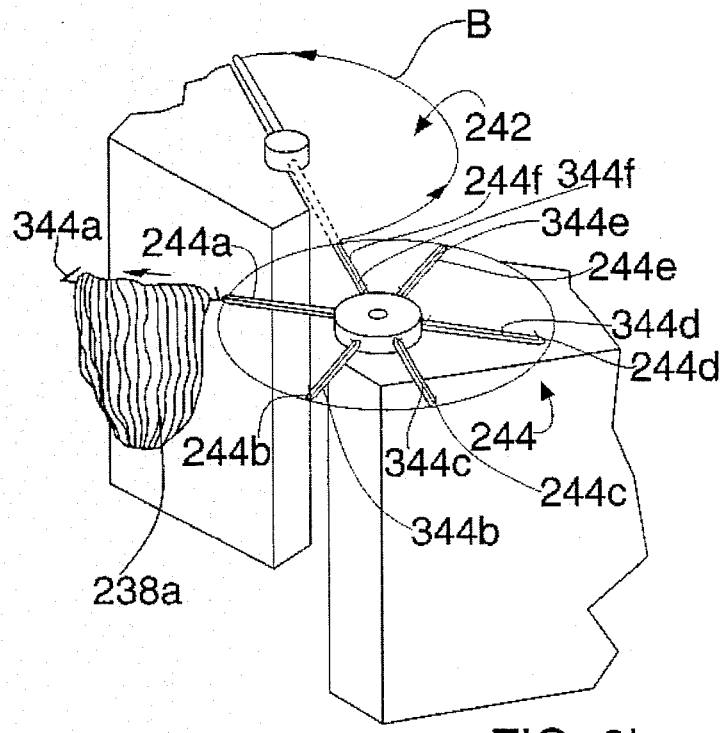

The process is continuous and is controlled by a main air switch controller 250, an on-off switch 252, and a speed control 254. When yarn loops with curled wire arrive at the positions shown in FIG. 8*h*, they are removed from wheel 244 by a pulling device (not shown) and transferred to a station where the ends of the curled wires can by attached to form rings from which the yarn loops hang as shown in FIG. 8*i*.

Each mop head contains approximately 275 feet of yarn and the mop heads are produced at the rate of about 6 per minute.

There have been described and illustrated herein several embodiments of an apparatus for manufacturing a fibrous yarn mop head, a method for for a making fibrous yarn mop heads and a fibrous yarn mop head made accordingly. While particular embodiments of the invention have been described, it is not intended that the invention be limited thereto, as it is intended that the invention be as broad in scope as the art will allow and that the specification be read likewise. Thus, while particular pneumatic driving mechanisms have been disclosed, it will be appreciated that other hydraulic or electric driving mechanisms could be utilized. Also, while chain type conveyors have been shown, it will be recognized that other types of conveyors could be used with similar results obtained. Moreover, while particular configurations have been disclosed in reference to the yarn winder, it will be appreciated that other configurations could be used as well. Furthermore, while the apparatus has been disclosed as having a central taping mechanism and a pair of fabric rolls, it will be understood that different means for creating end loops and bunching yarn in the center can achieve the same or similar function as disclosed herein. With regard to the method, it will be appreciated that not all of the steps need to be performed in the order stated. For example, the taping and stitching could be done simultaneously or sequentially. The insertion of the flexible ring could be before or after the yarns are cut. As to the mop head itself, it will be understood that a noticeable feature of the mop head made with the methods and machines disclosed is that it consists of two continuous strands of helically wound yarn. Nevertheless, it will be appreciated that the mop head could be made from one or more helically wound strands of yarn without departing from the spirit of the invention. It will also be understood that the yarn used to make the mop head is preferably cotton but that any suitably absorbent material could be used as well. The tape used to join the central portion of the yarn need not be very durable since it only needs to hold the yarn together until the mop head is installed after which time the yarns of the mop head are joined by the mop. The flexible ring which is threaded into the end loops of the mop head may be plastic or metallic or any suitable material which has enough strength and resilience to assume a generally ring shaped configuration after being threaded in a relatively straight path.

It will therefore be appreciated by those skilled in the art that yet other modifications could be made to the provided invention without deviating from its spirit and scope as so claimed.

We claim:

1. An apparatus for making fibrous yarn mop heads having a plurality of yarn loops with ends carried on a ring and middles bunched together, said apparatus comprising:

a) a first conveying means having an upstream end and a downstream end for moving yarn loops downstream;

b) yarn winding means located upstream of said first conveying means for helically winding a continuous supply of yarn around said first conveying means, said winding means and said first conveying means forming a downstream moving continuous helix of yarn, said helix of yarn having upper strands and lower strands;

c) first and second joining means located downstream of said winding means for joining portions of said upper strands and lower strands to form first and second end loops at opposite sides of said helix of yarn;

d) central bunching means for joining together a plurality of said upper strands and lower strands between said first and second end loops to form segregate groups of wound yarn;

e) cutting means for separating each of said segregate groups of wound yarn from one another;

f) downstream receiving means at said downstream end of said first conveying means for receiving said first and second end loops of each of said segregated groups of wound yarn; and g) flexible ring threading means for threading a flexible ring through said first and second end loops of each of said segregated groups of wound yarn.

2. An apparatus according to claim 1, wherein:

said first conveying means comprises a pair of laterally spaced apart chain conveyors.

3. An apparatus according to claim 1, wherein:

said yarn winding means comprises a rotating arm having a yarn carrying finger.

4. An apparatus according to claim 1, wherein:

said first and second joining means comprise first and second sewing machines.

5. An apparatus according to claim 4, wherein:

said first and second joining means further comprise first and second fabric rolls feeding respective first and second sewing machines with first and second fabric strips.

6. An apparatus according to claim 1, wherein:

said central bunching means comprises a taping mechanism for winding an adhesive tape around said plurality of upper and lower strands.

7. An apparatus according to claim 1, wherein:

said downstream receiving means comprises a plurality of rotating arms.

8. An apparatus according to claim 7, wherein:

said flexible ring threading means comprises a coaxial passage in one of said arms through which flexible ring material is fed.

9. An apparatus according to claim 1, wherein:

said downstream receiving means comprises a rotating wheel having a plurality of arms for receiving said first end loops and a reciprocating arm for receiving said second end loops, said reciprocating arm cooperating with said rotating wheel to place said second end loops on one of said plurality of arms with said first end loops.

10. A method of making fibrous yarn mop heads, comprising the steps of:

a) winding a continuous strand of yarn at a first winding rate around a pair of forward moving conveyors;

b) joining portions of said yarn at points adjacent to said conveyors to form end loops;

c) periodically reducing said first winding rate to segregate groups of wound yarn;

d) joining together a central portion of each of said segregated groups of wound yarn;

e) separating each of said segregated groups of wound yarn from one another;

f) gathering said end loops;

g) inserting a flexible ring material through said end loops; and h) joining ends of said flexible ring material to form a continuous ring.

11. A method according to claim 10, wherein:

said step of joining portions of said yarn at points adjacent to said conveyors to form end loops comprises stitching a fabric strip to said yarn.

12. A method according to claim 10, wherein:

said step of joining together a central portion of each of said groups of wound yarn comprises wrapping said yarn with adhesive tape.

13. A method according to claim 10, wherein:

said step of gathering said end loops comprises threading a movable rod through said end loops.

14. A method according to claim 13, wherein:

said step of inserting flexible ring material through said loops comprises threading a continuous supply of said ring material through said movable rod.

* * * * *